US011953211B2

(12) United States Patent
Li et al.

(10) Patent No.: US 11,953,211 B2
(45) Date of Patent: Apr. 9, 2024

(54) METHOD AND APPARATUS FOR REAL-TIME ANALYSIS OF DISTRICT HEATING PIPE NETWORK BASED ON TIME SEQUENCE DATA OF HEAT DEMAND

(71) Applicant: GS Power Co. Ltd., Anyang-si (KR)

(72) Inventors: Yuan Hu Li, Seoul (KR); Chang Yeol Yoon, Anyang-si (KR); Ki Song Lee, Anyang-si (KR); Kun Young Lee, Anyang-si (KR); Tae Gon Kim, Anyang-si (KR)

(73) Assignee: GS Power Co. Ltd., Anyang-si (KR)

( * ) Notice: Subject to any disclaimer, the term of this patent is extended or adjusted under 35 U.S.C. 154(b) by 0 days.

(21) Appl. No.: 18/157,731

(22) Filed: Jan. 20, 2023

(65) Prior Publication Data

US 2023/0235897 A1 Jul. 27, 2023

(30) Foreign Application Priority Data

Jan. 21, 2022 (KR) ..... 10-2022-0009560

(51) Int. Cl.
*F24D 19/10* (2006.01)
*F24D 10/00* (2022.01)

(52) U.S. Cl.
CPC ..... *F24D 19/1048* (2013.01); *F24D 10/00* (2013.01)

(58) Field of Classification Search
CPC ..... F24D 19/1048; F24D 10/00
USPC ..... 237/13
See application file for complete search history.

(56) References Cited

U.S. PATENT DOCUMENTS 10,262,518 B2 * 4/2019 Hyland ..... E03B 7/003
2022/0349773 A1 * 11/2022 Kristensen ..... E03B 7/072

FOREIGN PATENT DOCUMENTS

EP 3531368 A1 8/2019
JP 2004-252659 A 9/2004
KR 10-2013-0017368 A 2/2013
KR 10-2013-0089111 A 8/2013
KR 10-2018-0087965 A 8/2018
(Continued)

OTHER PUBLICATIONS

Song, Mingoo. "Development of Big Data System for Energy Big Data." Research Paper. KIISE Transactions on Computing Practices 24(1), 2018.1, 24-32(9 pages) Nov. 16, 2017 <https://doi.org/10.5626/KTCP.2018.24.1.24>.
(Continued)

*Primary Examiner* — Steven B McAllister
*Assistant Examiner* — John E Bargero
(74) *Attorney, Agent, or Firm* — BROADVIEW IP LAW, PC

(57) ABSTRACT

A method and an apparatus for real-time analysis of the district heating network is disclosed. According to an embodiment of the present disclosure, a method for analyzing a district heating network including pipes and fluids inside the pipes includes receiving, by a processor, pipe data representing a structure of the pipes; receiving, by the processor, input data on at least one of the physical state of the district heating network and the flow of fluids; calculating, by the processor, data for at least one of the physical state of the district heating network or the flow of fluids using the pipe data and the input data.

13 Claims, 6 Drawing Sheets

(56) References Cited

FOREIGN PATENT DOCUMENTS

KR 10-1886229 B1 8/2018

OTHER PUBLICATIONS

Lee, Jeongbin et al. "Dynamic modeling of the hydraulic-thermal behavior of the buried pipe network for district heating." Research Paper. Journal of Energy Engineering, vol. 21, No. 2, pp. 144~151 (2012) Jun. 11, 2012 <http://dx.doi.org/10.5855/ENERGY.2012.21.2.144>.

Kim, Jinkwon et al. "Pipe Flow Analysis of Daejon Dunsan District Heating." Proceedings of the KFMA Annual Meeting , 2006.8, 1391-1396(6 pages). NCFE 2006, KyungJu, Korea. Aug. 25, 2006 <http://www.dbpia.co.kr/journal/articleDetail?nodeId=NODE01173038>.

Park, Jong Jun et al. "A Study of Heat Loss Using Numerical Methods in Apartment Utility Space." Journal. Journal of the Korean Society of Living Environmental System 24(1), 2017.2, 10-17(8 pages) <http://dx.doi.org/10.21086/ksles.2017.02.24.1.10>.

Office Action for KR 10-2022-0009560 by Korean Intellectual Property Office dated Feb. 15, 2022.

Song, Mingoo. "Development of Big Data System for Energy Big Data." Research Paper. KIISE Transactions on Computing Practices, vol. 24, No. 1, pp. 24-32. Nov. 16, 2017. <https://doi.org/10.5626/KTCP.2018.24.1.24>.

Lee, Jeongbin et al. "Dynamic modeling of the hydraulic-thermal behavior of the buried pipe network for district heating." Research Paper. Journal of Energy Engineering, vol. 21, No. 2, pp. 144~151. Jun. 11, 2012. <http://dx.doi.org/10.5855/ENERGY.2012.21.2.144>.

Kim, Jinkwon et al."Pipe Network Flow Analysis of Daejon Dunsan District Heating." Research Paper. Proceedings of the KFMA Annual Meeting , 2006.8, 1391-1396. Aug. 25, 2006 <http://www.dbpia.co.kr/journal/articleDetail?nodeId=NODE01173038>.

Park, Jong Jun et al. "A Study of Heat Loss Using Numerical Methods in Apartment Utility Space." Research Paper. Journal of the Korean Society of Living Environmental System 24(1), 2017.2, Feb. 10-17, 2017. <http://dx.doi.org/10.21086/ksles.2017.02.24.1.10>.

Extended European Search Report for EP 23152602.1 by European Patent Office dated Jun. 21, 2023.

* cited by examiner

METHOD AND APPARATUS FOR REAL-TIME ANALYSIS OF DISTRICT HEATING PIPE NETWORK BASED ON TIME SEQUENCE DATA OF HEAT DEMAND

CROSS-REFERENCE TO RELATED APPLICATIONS

This application claims priority under 35 U. S. C § 119 to Korean Patent Application No. 10-2022-0009560 filed in the Korean Intellectual Property Office on Jan. 21, 2022, the entire content of which is hereby incorporated by reference.

TECHNICAL FIELD

The present disclosure relates to a method and an apparatus for real-time analysis of a district heating network based on time sequence data of heat demand. This invention was supported by the Energy Efficiency & Resources Core Technology Program of the Korea Institute of Energy Technology Evaluation and Planning (KETEP) and was funded by the Ministry of Trade, Industry & Energy, Republic of Korea (No. 20192010106990).

BACKGROUND

The content described in this section merely provides background information for the present disclosure and does not constitute prior art.

The district heating network is a heat supplying system that utilizes pressurized hot water as a heat transfer medium to supply thermal energy generated by a central heat source to consumers in urban scale regions. The analysis system of the conventional district heating network provides only information (temperature, flow rate, pressure) measured at the heat source of the district heating network and at the consumer. That is, the conventional district heating network analysis system provides information only on the starting point and very end point of the pipes. Therefore, a user of such analysis system (e.g. operator of the district heating network) cannot know the state at various points in the middle of the district heating pipe network. The user of the conventional analysis system may use information measured at the consumers to check only whether heat is being supplied at the consumer but cannot check the fluid flow and heat flow state inside the pipes that traverse the heat source and consumer. As a result, it is difficult for the operator of the district heating network to provide optimized operation for the actual state of the district heating network.

Properties such as pressure and temperature of the district heating pipe network are necessary elements for evaluating heat loss and lifespan of the pipes. Despite this, the conventional district heating pipe network control system is not able to provide information on such properties. Thus it is difficult for the operator of the district heating pipe network to evaluate the state of the pipes or manage based on results of such evaluations.

SUMMARY

Accordingly, the present disclosure has been made to improve the above-mentioned problems. The real-time district heating network analysis method and analysis device according to an embodiment of the present disclosure can provide the physical state of all sections of the district heating network pipes in time sequence data.

In addition, the district heating network real-time analysis method and analysis apparatus according to an embodiment of the present disclosure may provide information on the physical state of the district heating network in real-time.

The problems to be solved by the proposed invention are not limited to the above-mentioned problems, and other problems not mentioned will be clearly understood by a person of ordinary skill in the art from the following description.

According to an embodiment of the proposed disclosure, a method for analyzing a district heating network including pipes and fluids inside the pipes includes a process of a processor receiving pipe data representing a structure of the pipes; a process of the processor receiving input data on at least one of the physical state of district heating network and the flow of fluids; a calculation process in which the processor calculates data for at least one of the physical state of the district heating network and the flow of fluids using the pipe data and the input data.

According to an embodiment of the present disclosure, an apparatus for analyzing a district heating network including pipes and fluids inside the pipes includes a processor that receives the pipe data representing the structure of the pipes, input data on at least one of the physical state of the district heating network and the flow of the fluids, and calculates calculation data on at least one of the physical state of the district heating network and the flow of fluids using the pipe data and the input data.

As described above, the district heating network analysis method and analysis apparatus according to an embodiment of the present disclosure have the effect of providing real-time information on the physical state of the district heating network in real-time.

In addition, a district heating network analysis method and analysis apparatus according to an embodiment of the present disclosure may provide information on the physical state of the district heating network in real-time.

DETAILED DESCRIPTION

Figure 1:
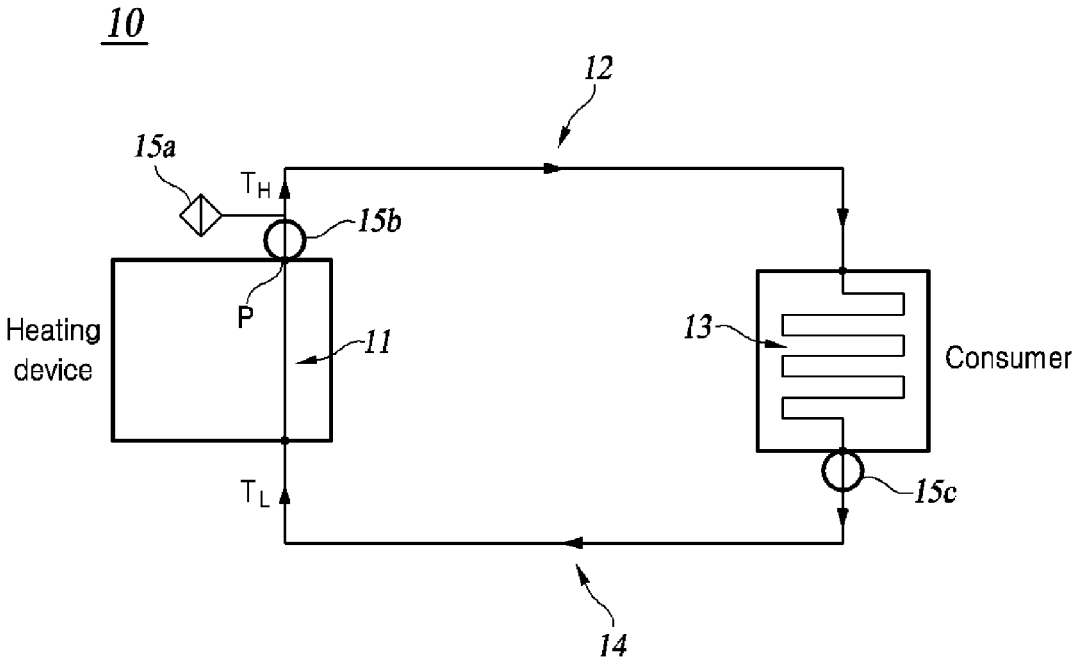
FIG. 1 is a schematic diagram showing the configuration of a district heating network for explaining an analysis method according to an embodiment of the present disclosure.

Hereinafter, some embodiments of the present disclosure are described in detail through exemplary drawings. In the following description, like reference numerals designate like elements, although the elements are shown in different drawings. Furthermore, in the following description of various exemplary embodiments of the present disclosure, a detailed description of known functions and configurations incorporated therein has been omitted for clarity and for brevity.

Additionally, various terms such as first, second, A, B, (a), (b), etc., are used solely to differentiate one component from the other but not to imply or suggest the substances, order, or sequence of the components. Throughout this specification, when a part 'includes' or 'comprises' a component, the part is meant to further include other components, not to exclude other components unless specifically stated to the contrary. The terms such as 'unit', 'module', and the like refer to one or more units for processing at least one function or operation, which may be implemented by hardware, software, or a combination thereof.

FIG. 1 is a schematic diagram showing the configuration of a district heating network for explaining an analysis method according to an embodiment of the present disclosure.

Referring to FIG. 1, the district heating network 10 is a system for supplying thermal energy generated by one or more heating sources to consumers of the region by using pressurized hot water as a heat transfer medium. A place or facility that is supplied with and consumes thermal energy from the pressurized hot water of the district heating network 10 is referred to as a consumer. The high-temperature fluid supplied with thermal energy in the heating section 11 inside the heating source is transported to the consumer along the supply pipe 12 of the district heating network 10. The high-temperature fluid transported to the consumer transfers thermal energy to the consumer in the emission section 13 and returns to the heating source along the return pipe 14. Here, the supply pipe 12 refers to a section of pipe that defines a path through which fluid flows from the outlet of the heating section 11 to the inlet of the emission section 13. The return pipe 14 refers to the section of the pipe that defines the path through which the fluid flows from the outlet of the emission section 13 to the inlet of the heating section 11.

Figure 2:
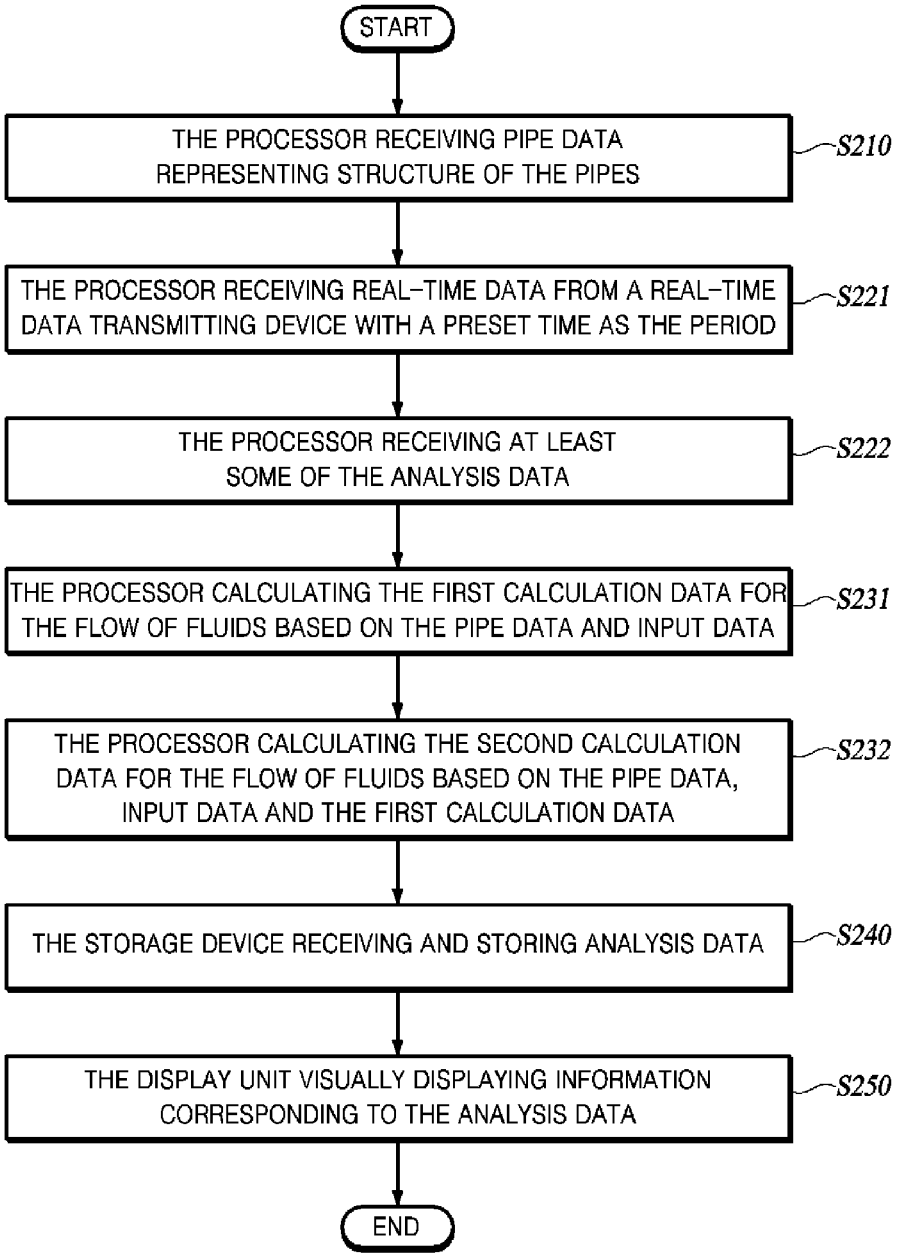
FIG. 2 is a flowchart showing a district heating network analysis method according to an embodiment of the present disclosure.

FIG. 2 is a flowchart showing a district heating network analysis method according to an embodiment of the present disclosure.

As shown in FIG. 2, in steps S210 to S222, the processor 330 collects data for analyzing the flow of fluid or physical state of the district heating network 10. In FIG. 2, the processor is shown to receive the input data after receiving pipe data, but present disclosure is not limited thereto. The present disclosure includes embodiments in which the processor 330 simultaneously receives pipe data and input data, or receives input data first.

In step S210, the processor 330 receives pipe data indicating the structure of the pipe. The pipe data may include data on at least one of a cross-sectional area, a length, or a heat loss coefficient of at least one section of the pipe. Here, the cross-sectional area refers to the cross-sectional area of the hollow inside the pipe cut in a direction perpendicular to the flow path of the fluid. When the pipe is formed in a cylindrical shape, the data on the cross-sectional area may correspond to, for example, the inner diameter of at least some sections of the pipe.

Figure 3:
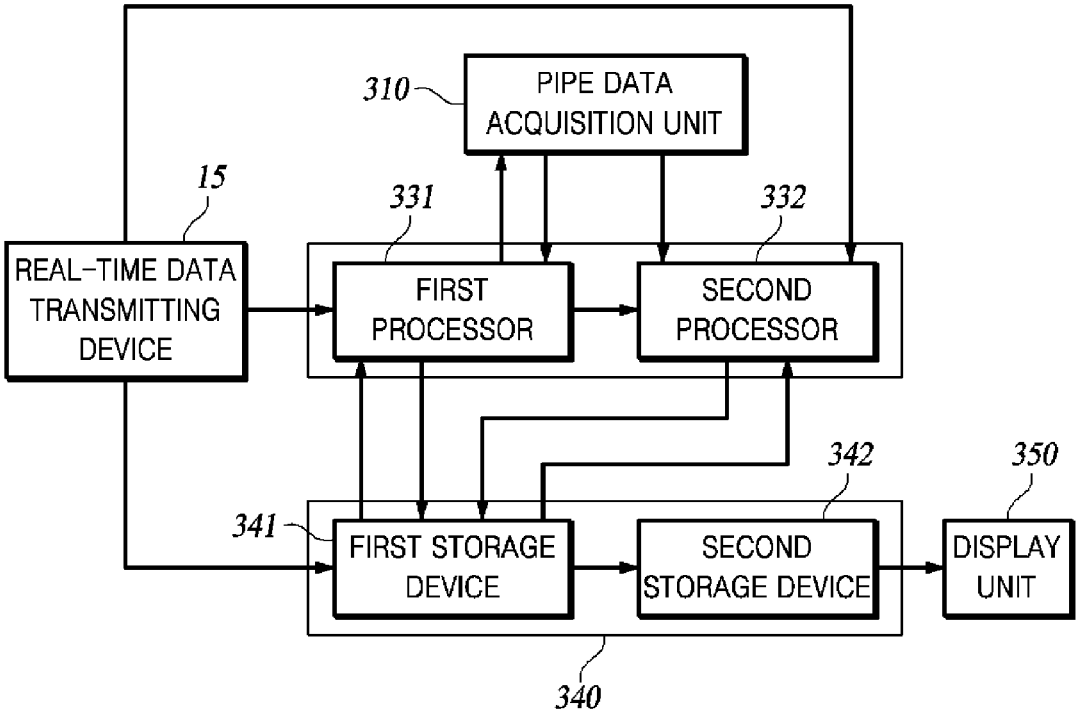
FIG. 3 is a schematic diagram showing the configuration of an analysis apparatus for explaining the process of receiving and calculating pipe data according to an embodiment of the present disclosure.

FIG. 3 is a schematic diagram showing an analysis apparatus for explaining a process of receiving and calculating pipe data according to an embodiment of the present disclosure.

Figure 4:
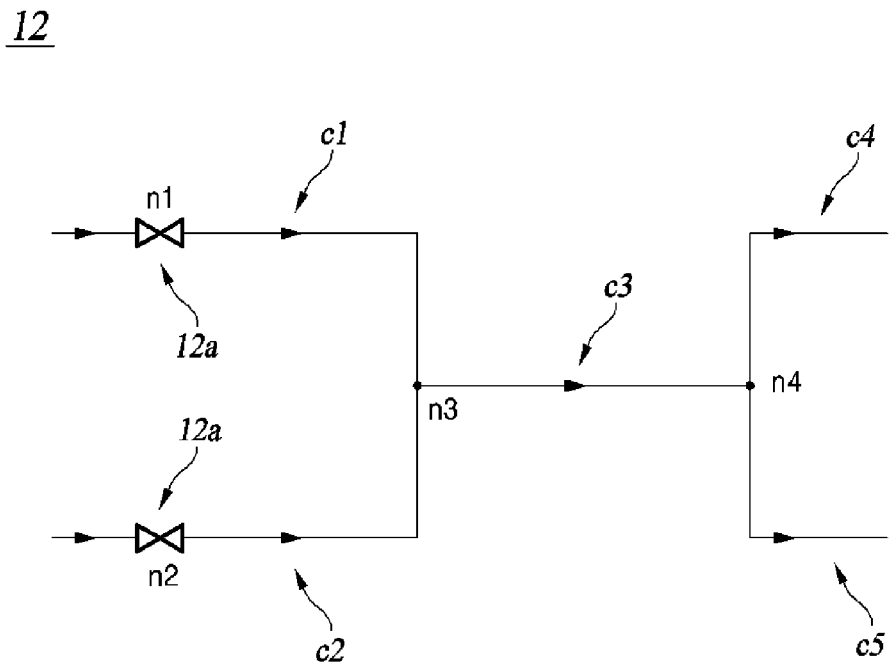
FIG. 4 is a schematic diagram showing a supply pipe for explaining the process of receiving and calculating pipe data according to an embodiment of the present disclosure.

FIG. 4 is a schematic diagram showing a supply pipe for explaining a process of receiving and calculating pipe data according to an embodiment of the present disclosure.

Figure 5:
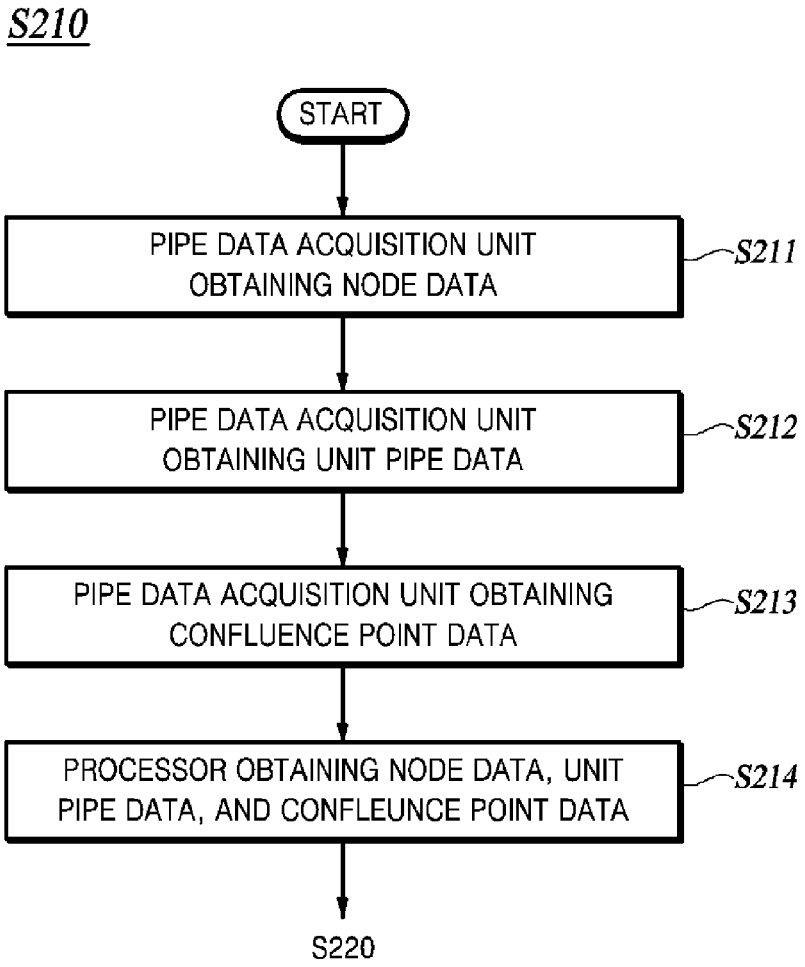
FIG. 5 is a flowchart of a process of receiving pipe data according to an embodiment of the present disclosure.

FIG. 5 is a flowchart of a process of receiving pipe data according to an embodiment of the present disclosure.

Referring to FIG. 2 to FIG. 5, in steps S211 to S214, several points on the pipe are designated as nodes n1, n2, n3, and n4. A point and/or section on a pipe defined by several nodes n1, n2, n3, and n4 may be subject to analysis by the analysis method of the present disclosure.

In the pipe data receiving step S210 according to an embodiment of the present disclosure, a pipe data acquisition unit 310 obtains node (n1, n2, n3, n4) data on the nodes n1, n2, n3, and n4 of the pipe (S211). The nodes n1, n2, n3, and n4 may include points at which the cross-sectional area of the pipe changes. When at least one valve 12*a* is installed in the pipe, the nodes n1, n2, n3 and n4 may further include a valve (12*a*) installation point. In addition, a point at which separated flow areas are merged along the flow direction of the fluid or flow areas are separated along the flow direction of the fluid may be further included. A plurality of unit pipes c1, c2, c3, c4, and c5 are defined by several nodes n1, n2, n3, and n4. For example, the pipe may be divided into a plurality of sections based on each of the nodes n1, n2, n3, and n4, and each respective section may be defined as a unit pipes c1, c2, c3, c4, and c5.

Subsequently, the pipe data acquisition unit 310 obtains unit pipe (c1, c2, c3, c4, c5) data on cross-sectional area, length, and heat loss coefficient of at least one of the unit pipes c1, c2, c3, c4 and c5. The unit pipe (c1, c2, c3, c4, c5) data may further include data on the interconnection relationships of the plurality of unit pipes c1, c2, c3, c4, and c5. The cross-sectional area, length and heat loss coefficient of the unit pipes c1, c2, c3, c4, and c5 may not change for a long period of time. Therefore, some of the unit pipe (c1, c2, c3, c4, c5) data may be obtained by the user simply inputting the cross-sectional areas and the like of the unit pipes c1, c2, c3, c4 and c5 into the pipe data acquisition unit 310.

The pipe data acquisition unit 310 may obtain confluence point data about a confluence point at which a plurality of flow areas separated from each other are merged along the flow direction of the fluid (S213). In the confluence point data acquisition step S213 according to an embodiment of the present disclosure, the confluence point data may include data on which of at least one node n1, n2, n3, and n4 is a confluence point. In order to obtain these data, the pipe data acquisition unit 310 obtains data on the starting point and the ending point of the plurality of unit pipes c1, c2, c3, c4, c5. Here, the starting point means a point at which the fluid flows in, and the ending point means a point at which the fluid flows out. Because the unit pipes c1, c2, c3, c4, and c5 are defined with at least one node n1, n2, n3, and n4 as the boundary, the starting point and ending point of any unit pipe c1, c2, c3, c4, and c5 are all nodes n1, n2, n3, n4. Data on the starting point of the unit pipes c1, c2, c3, c4, and c5 may be data indicating which node (n1, n2, n3, n4) is the starting point of each respective unit pipe c1, c2, c3, c4, and c5 for all unit pipes c1, c2, c3, c4, and c5. Likewise, data on the ending point of the unit pipes c1, c2, c3, c4, and c5 may be data indicating which node (n1, n2, n3, n4) is the ending point of each respective unit pipe c1, c2, c3, c4, and c5 for all unit pipes c1, c2, c3, c4, and c5.

The pipe data obtaining unit 310 may use data on the flow velocity to obtain data on the starting point and the ending point. If the fluid flows from the first node n1, n2, n3, and n4 to the second node n1, n2, n3, and n4 in the unit pipe c1, c2, c3, c4, c5 whose boundary is defined by the first node n1, n2, n3, and n4 and the second node n1, n2, n3, and n4, the first node n1, n2, n3, and n4 is the starting point of that unit pipe c1, c2, c3, c4, c5 and the second node n1, n2, n3, and n4 may be determined as the ending point. The pipe data acquisition unit 310 may determine which of the at least one node n1, n2, n3, n4 is the confluence point and which is the divergence point based on the data on the starting point and the ending point. For example, the pipe data acquisition unit 310, for any node n1, n2, n3, and n4, may use a method that determines that node n1, n2, n3, n4 as a divergence point when that node is the starting point of two of the unit pipes c1, c2, c3, c4, c5, and determines that node n1, n2, n3, n4 as a confluence point when that node is the ending point of two of the unit pipes c1, c2, c3, c4, c5. However, the process of obtaining confluence point and divergence point data is not limited to the present disclosure.

In step S214, the processor 330 receives node (n1, n2, n3, n4) data, unit pipe (c1, c2, c3, c4, and c5) data, and confluence point and divergence point data. The processor 330 may generate calculation data for the physical properties and flow of the fluid of the district heating network 10 through the following calculation process using the pipe data and the input data. Here, the input data is data on at least one of the flow of the fluid or the physical state of the district heating network 10. In steps S221 and S222, the processor 330 receives input data.

Referring back to FIG. 2, the processor 330 receives input data about the flow of the fluid and/or physical state of the district heating network 10 in addition to the pipe data. Such input data may include at least some of real-time data and analysis data. Although only a process of receiving at least some of real-time data and analysis data is shown in FIG. 2, the process of receiving input data of the present disclosure is not limited to this example. In the process of receiving input data, flow of the fluid or physical state of the district heating network 10 may be received as data that is not part of real-time data or analysis data.

In step S221, the processor 330 receives real-time data from the real-time data transmitting device 15 installed in the district heating network 10 with a preset time as the period. Real-time data is data that reflects in real-time the fluid flow and/or physical state of the heating device 11 and consumer 13 which are the starting point and ending point of the district heating network 10. Real-time data may include, for example, real-time pressure data and real-time flow rate data. Here, the real-time pressure data refers to data on the pressure of the fluid at at least one point of each pipe. Real-time flow rate data refers to data on the flow rate of the fluid at at least one point in a pipe.

In the process of receiving real-time data, the processor 330 may receive the latest data stored in the database of heating facilities configured to heat the fluid in the district heating network 10. The data received in this way may be about the state of the high-temperature and high-pressure fluid heated by the heating facility. The processor 330 may receive the latest data stored in the consumer's heating facility database. The data received in this way may be about the temperature and flow rate of the fluid in the supply pipe 12 and the return pipe 14 of the consumer. However, the receiving process of the present disclosure is not limited to this embodiment. For example, in the process of receiving data, the processor 330 may directly receive the data from the temperature sensor 15*b* and pressure sensor 15*a* installed on the heating facility side and the data measured by the heat measurement device 15*c* installed in the consumer and the like. In addition, real-time data may include data on the opened/closed state of valves 12*a* installed in pipes. Using the data on the opened/closed state of the valve 12*a*, the processor can calculate data tracking the real-time opened/closed state of the valve 12*a*.

In addition, the data calculated by the processor 330 of the present disclosure using the real-time data corresponds to the state of the district heating network 10 at the time of generating the real-time data. Thus, the analysis method according to an embodiment of the present disclosure has an effect of analyzing in real-time the state of the district heating network 10, which frequently changes due to heat consumed, ambient environment, or temperature and fluid supply pressure of the heating facility. In step S240, which will be described below, the storage device 340 stores calculation data generated by the processor 330 over time in a time-sequence manner.

In step S222, the processor 330 receives at least a portion of the analysis data. Analysis data refers to data stored by the storage device 340 in step S240 of the present disclosure. Analysis data may include information calculated using data input by a processor 330 in the present disclosure. Therefore, the analysis method of the present disclosure can provide not only actual measured data, but also more accurate and diverse information on the district heating network 10 by using the data previously calculated by the processor 330.

The fluid flow and/or physical state of the district heating network 10 may change over time. For example, at the starting point of a unit pipe c1, c2, c3, c4, c5 the temperature of fluid may be $T_1$ at time $t_1$ and may be $T_2$ at time $t_1+\Delta t$. In this case, if the time taken for the fluid to pass through the unit pipe c1, c2, c3, c4, or c5 is $t_1+\Delta t$ the temperature of the fluid, which passes the ending point of the unit pipe c1, c2, c3, c4, or c5 at time $t_1+\Delta t$, passing the starting point at time $t_1$ is $T_1$. If only the temperature of the fluid passing the starting point at time $t_1+\Delta t$ is used to calculate the temperature of the fluid passing the ending point at $t_1+\Delta t$, an inaccurate value will be calculated. Due to temperature difference with the ambient environment, heat is lost from the fluid over time. Accordingly, the temperature of the fluid arriving at the ending point at time $t_1+\Delta t$ may be different from the temperature of the fluid at the starting point at time $t_1$.

Analysis data according to an embodiment of the present disclosure is generated using real-time data received with a preset time as the period. Accordingly, the analysis data may include information about the fluid flow and/or physical state of the district heating network 10 at various points in time. Accurate information about the state of the district heating network 10 that changes over time can be obtained using these data.

The input data may also include, data on the ambient temperature of the pipe (hereinafter referred to as 'ambient temperature data'). When the pipe is buried in the ground, the ambient temperature of the pipe may mean the underground temperature. The data on the underground temperature may be data generated in real-time by a temperature sensor or the like installed around the pipe. In the calculation process of the present disclosure, the processor 330 calculates calculation data for the fluid flow and/or physical state of the district heating network 10 based on the above-described pipe data and input data. According to the analysis method of the present disclosure, information corresponding to the flow of fluid in all sections of the pipe can be obtained even with limited data on some points of the pipe.

Figure 6:
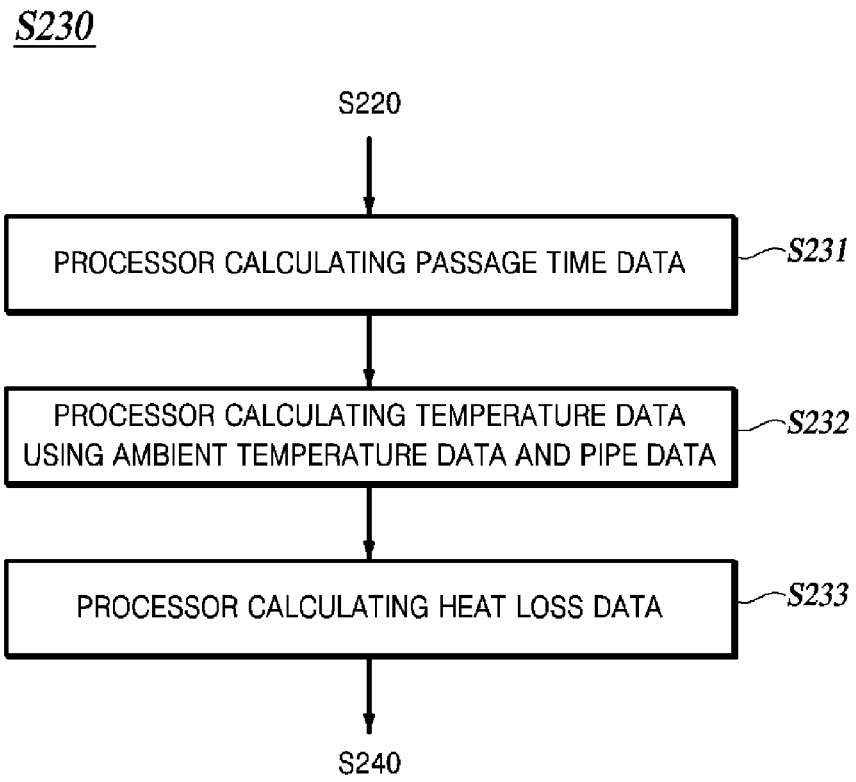
FIG. 6 is a flowchart illustrating a calculation process according to an embodiment of the present disclosure.

FIG. 6 is a flowchart illustrating a calculation process according to an embodiment of the present disclosure.

Referring to FIG. 3 to FIG. 6, in step S231, the processor 330 calculates first calculation data for fluid flow based on the pipe data and the input data. The first calculation data may include passage time data. Below, the analysis point or analysis section means a point to be analyzed or a section to be analyzed, respectively. Reference section means the section connecting the analysis point and the reference point on the pipe. The passage time data refers to the data representing time taken for the fluid to flow and pass through the analysis section of the pipe with respect to each of the at least one analysis section. For example, for a pipe comprising a combination of a plurality of unit pipes c1, c2, c3, c4, c5, the passage time data may be data on the time taken for fluid to pass through each unit pipe c1, c2, c3, c4, c5. The passage time taken for the fluid to pass through the analysis section of the pipe can be calculated using the flow rate of the fluid passing through the section at each time, the pipe inner diameter of the section and the pipe length. The fluid can be said to have passed through the analysis section when the sum of flow rate of the fluid that flowed in the analysis section within the passage time is the same as the volume of the analysis section. For example, if the volume of the analysis section is 200 L, the amount of fluid that flows in 1 minute is 20 L, the amount of fluid that flows in 2 minutes is 50 L, and the amount of fluid that flows in 3 minutes is 30 L, it may be determined that the fluid took 3 minutes to pass through the analysis section. The first processor 330 may generate passage time data using this integral equation. To this end, the processor may calculate the volume of the unit pipe c1, c2, c3, c4, c5 by using pipe inner diameter information of the pipe data and calculate the accumulated flow rate with flow amount rate value for each hour. The processor may use the equation below to calculate the passage time.

$$V = \pi \times \left(\frac{d}{2}\right)^2 \times L_{-} \tag{1}$$

$$V = \sum_{i=0}^{t} F_t,$$

$$\pi \times \left(\frac{d}{2}\right)^2 \times L = \sum_{i=0}^{t} F_t.$$

V: Unit pipe volume
d: Unit pipe inner diameter
L: Length of unit pipe
Ft: Fluid flow rate at time point t
t: Reach time The first calculation data includes elapsed time data indicating the time taken to pass through the reference section of the pipe for each of at least one reference section. Such elapsed time data for each reference point is saved to the database as time sequence data per time point. The reference point may be a point at which high-temperature fluid is supplied to the supply pipe 12 (hereinafter 'supply point (p)'). The supply point (p), for example, may be a point where the fluid is output from the heating section 11 inside the heating facility. Between the supply point (p) and the reference point there are one or more reference sections connected with/by nodes and the sum of elapsed time per point of such reference sections may be the elapsed time for a fluid to reach the reference point from the supply point (p). Using elapsed time data, if time taken for the fluid to flow to a certain point from the supply point (p) is known, it is possible to know the time the fluid that reached the certain point started from the supply point (p) and the temperature and pressure of the fluid supplied at that time point can be known from the database.

The manager or control device of the district heating network 10 can adjust the temperature and flow rate of the fluid to an appropriate value at the temperature of the heat source or the supply point (p) using the elapsed time data. If at any point in time the temperature of the fluid passing the analysis point is higher than the optimal value, it may be determined that the temperature of the fluid was increased more than required at the supply point (p) and the resulting energy consumption of the heating section is increased and simultaneously that heat loss occurring while the fluid moves to the consumer also increases. On the other hand, if at any point in time the temperature of the fluid passing through the analysis point is lower than the optimal value, the supply amount of the fluid at the supply point (p) should be increased and this will increase energy consumption of the fluid supply pump of the supply point. In addition, the first data calculated by the processor 330 may include calculated pressure data on the fluid pressure and head data on the head of the fluid at at least one point of the pipe.

In step S232, the processor 330 calculates second calculation data for the movement of heat inside the district heating network 10 based on the input data and the first calculation data. In the analysis method according to an embodiment of the present disclosure, the processor 330 may include a first processor 331 performing a first calculation process and a second processor 332 performing a second calculation process. The second calculation data may include temperature data on the temperature of the fluid at at least one point in the pipe. The processor 330 uses ambient temperature data and pipe data to calculate temperature data. In one embodiment of the present disclosure, the processor 330 uses confluence point data to calculate temperature data. When the ending point of a unit pipe c1, c2, c3, c4, c5 is not a confluence point, only the temperature of the fluid at the starting point of the unit pipe c1, c2, c3, c4, c5 and the heat lost to the outside of the pipe need to be considered in order to obtain the temperature of the fluid at the ending point. In this case, the processor may calculate the temperature data using Equation 2 below.

$$T_{en} = e^{\frac{f}{\pi \cdot \left(\frac{d}{2}\right)^2} \cdot T_s + ln(T_s - T_g)} + T_g \tag{2}$$

$T_{en}$: Fluid temperature at the ending point
$T_s$: Fluid temperature at starting point
d: Pipe internal diameter
$T_g$: Underground temperature
f: Heat loss coefficient (kcal/min·m·k)

However, when the ending point of a unit pipe c1, c2, c3, c4, c5 is a confluence point, both the temperature and flow rate of the fluid in the two unit pipes c1, c2, c3, c4, c5 sharing a node must be considered in order to obtain the temperature of the fluid at the ending point. Therefore, the processor 330 may vary the temperature calculation algorithm at that node n1, n2, n3, or n4 according to whether the node n1, n2, n3, or n4 to be analyzed is a confluence point. For example, if a node is not a confluence point, the processor may calculate data on the temperature at that point using Equation 2. In contrast, when a certain node is fluid confluence point of a first unit pipe and a second unit pipe, the processor can calculate the temperature of the fluid at the confluence point using Equation 3.

$$T_{en} = \frac{T_{en}^1 \cdot F^1 + T_{en}^2 \cdot F^2}{F^1 + F^2} \tag{3}$$

$T_{en}$: Temperature of fluid at confluence point $T_{en}^{1}$: Fluid temperature at ending point (Note. Equation 2), $T_{en}^{1}$: Fluid temperature at ending point (Note. Equation 2), $F^{1}$: First unit pipe flow rate $F^{2}$: Second unit pipe flow rate Accordingly, even if pipes of the district heating network 10 have a structure including a plurality of unit pipes c1, c2, c3, c4, c5, the processor 330 can calculate data accurately reflecting the state of the district heating network 10. In addition, the second calculation data may include heat loss data on the heat loss of at least one of the unit pipes c1, c2, c3, c4, c5. The processor 330 may use unit pipe c1, c2, c3, c4, c5 data and temperature data in order to calculate heat loss data. The processor 330 can calculate in real-time the heat loss of all unit pipes constituting the district heating network 10, and may perform evaluation on the heat loss of the heat pipe network by storing in the storage device 340 the total sum in time sequence manner.

The calculation process described above can be performed independently of the supply pipe 12 and the return pipe 14. When analyzing for the return pipe 14 the multiple emission sections 13 of the district heating network 10 becomes the initial starting point of the fluid and the heating section 11 becomes the final ending point of the fluid. For example, the processor 330 may perform an analysis on the return pipe 14 in the same method as the analysis of the supply pipe 12.

In step S240, the storage device 340 receives and stores the analysis data. Here, the analysis data is at least some of the pipe data, the input data, or the calculation data, and relates to the physical state of the district heating network 10 and/or the fluid flow. At least some of this analysis data may be transmitted back to the processor 330 as pipe data and/or input data. The storage device 340 may store analysis data in a time-sequence manner. As described above, the analysis method of the present disclosure can obtain accurate information about the state of the district heating network 10 that changes over time by using time-sequence data stored in a storage device 340.

The storage step S240 according to an embodiment of the present disclosure may include a process of temporarily storing data to be updated among a first storage device 341 storing analysis data and a second storage device 342 storing analysis data. The second storage device 342 may for example store only analysis data received for three days, and update stored data by deleting data that was stored the longest time ago and storing new analysis data if new analysis data is received. The analysis data stored in the second storage device 342 is used in the calculation process. The first storage device 341 may permanently store the analysis data received from the second storage device 342.

In step S250, the display unit 350 may receive the analysis data and visually display the physical state of the district heating network 10 corresponding to the analysis data. Administrators of the district heating network 10 can monitor the information shown in the display unit 350 and control or manage the district heating network 10 based on the information. Specifically, the display unit 350 may receive the data stored in the second storage device 342 to indicate the state of the district heating network 10 corresponding to that data. By such indicating process, the operator can conduct real-time monitoring of the district heating network 10 and conduct analysis on past data of the district heating network 10.

The operator of the district heating network 10 can utilize the information displayed in the display unit in various ways. The operator can control the operation of the district heating network 10 or evaluate the state of the district heating network 10 based on the information displayed. For example, the operator can use information on the pressure or head of the fluid inside the pipe to monitor in real-time whether the fluid is being supplied smoothly to the user. The operator may adjust power input to the pump (not shown) according to information on the amount of the pressure lost in any section of the pipe. Information on the temperature of each point of the district heating network 10 may be used by the operator to evaluate the stress change or durability of the pipe at each point.

Such operation process may be performed by a control unit (not shown) of the district heating network 10 by an algorithm made with a programming language. For example, the control unit may receive analysis data stored in the storage device and use it to generate control signals to control the operation of the device installed in the district heating network 10. In the case that the flow rate supplied to the consumer is determined to be less than the expected value based on the analysis data, the control unit may control the pump, valve 15*a* on the district heating network 10 or the like such that the flow rate supplied to the supply pipe 12 passing through the consumer is increased.

Referring to FIG. 3, the district heating network 10 analysis apparatus according to an embodiment of the present disclosure includes at least some of a pipe data acquisition unit 310, a processor 330, a first storage device 341, a storage device 340 or a display unit 350. The composition and function of the district heating network 10 analysis apparatus is substantially the same as the composition and function of devices for performing the analysis method described above, and a description thereof will be omitted.

The processor 330 may include a first processor 331 and a second processor 332. The first processor 331 uses pipe data and input data to calculate the first calculation data for the flow of the fluid. The second processor 332 uses pipe data, input data, and the first calculation data to calculate the second calculation data for movement of heat inside the district heating network 10.

The real-time data transmitting device 15 transmits at least some of the input data in real-time to the processor 330 with a preset time as a period. The processor 330 can use the real-time data transmitted by the real-time data transmitting device to calculate the data corresponding to the state of the district heating network 10 that changes over time. The storage device 340 can store at least some of the input data and the calculation data in a time-sequence manner.

The above description is only an example of the technical idea of the present embodiment, and those having ordinary skill in the art to which this embodiment belongs should appreciate that various modifications, additions, and substitutions are possible, without departing from the technical idea and scope of the present disclosure. Therefore, embodiments of the present disclosure have been described for the sake of brevity and clarity. The scope of the technical idea of the present embodiments is not limited by the illustrations. Accordingly, one of ordinary skill should understand that the scope of the present disclosure is not to be limited by the above explicitly described embodiments but by the claims and equivalents of the claims.

What is claimed is:

1. A method for analyzing a district heating network analysis including pipes and fluids inside the pipes, method comprising:

a pipe data receiving process of receiving, by a processor, pipe data representing a structure of the pipes;

an input data receiving process of receiving, by the processor, input data on at least one of flow of the fluids or a physical state of the district heating network;

a calculation process of calculating calculation data on at least one of the flow of the fluids or the physical state of the district heating network by the processor by using of the input data and the pipe data; and a storing process of storing, in a time-sequence manner, analysis data including at least some of the calculation data, at least some of the input data, and at least some of the pipe data by a storage device, wherein the input data comprises:

the analysis data; and real-time data on at least one of the flow of the fluids or the physical state of the district heating network transmitted to the processor in preset time period from a real-time data transmitting device installed in the district heating network, wherein the calculation process comprises:

a first calculation process in which the processor calculates a first calculation data on the flow of the fluids by using the input data and the pipe data; and a second calculation process in which the processor calculates a second calculation data on movement of heat inside the district heating network by using the first calculation data, the input data, and the pipe data, wherein receiving, the processor, the pipe data comprises:

obtaining, by a pipe data acquisition unit, node data on at least one node including a point at which a flow area of the fluids is separated along a flowing direction of the fluids, a point at which a plurality of mutually separated flow areas of the fluids are combined along the flowing direction of the fluids, a point at which a valve is installed, and a point at which the cross-sectional area of the pipes changes;

obtaining unit pipe data on a heat loss coefficient, a length, and the cross-sectional area of at least one of a plurality of unit pipes defined by at least one of the nodes;

obtaining, by the pipe data acquisition unit, confluence point data on a confluence point at which the plurality of mutually separated flow areas of the fluids are combined along the flowing direction of the fluids; and receiving, by the processor, the confluence point data, the unit pipe data, and the node data, wherein the pipe data comprises the confluence point data, the unit pipe data, and the node data, and wherein the calculation process is calculating data on temperature of the node using the equation $$T_{en} = e^{\frac{f}{\pi\cdot\left(\frac{d}{2}\right)^2}\cdot T_s + ln(T_s - T_g)} + T_g$$

when the node is not the confluence point, wherein $T_{en}$ is a fluid temperature at the ending point, $T_s$ is a fluid temperature at starting point, d is a pipe internal diameter, $T_g$ is an underground temperature, f is a heat loss coefficient, and calculating data on the temperature of the node using the equation $$T_{en} = \frac{T_{en}^1 \cdot F^1 + T_{en}^2 \cdot F^2}{F^1 + F^2}$$

when the node is the confluence point, wherein $T_{en}$ is temperature of fluid at confluence point, $T_{en}^1$ is fluid temperature at ending point, $F^1$ is a first unit pipe flow rate, and $F^2$ is second unit pipe flow rate.

2. The method of claim 1, wherein the real-time data comprises real-time pressure data on pressure of the fluids at least one point of the pipes and real-time flow rate data on flow rate of the fluids at the at least one point of the pipes.

3. The method of claim 2, wherein the first calculation process comprises calculating, by the processor, passage time data indicating a time taken for the fluids to flow and pass through an analysis section of the pipes for each of at least one analysis section, wherein the first calculation data includes the passage time data.

4. The method of claim 3, wherein the input data further comprises ambient temperature data on ambient temperature of the pipes and the second calculation data comprises temperature data on temperature of the fluids at the at least one point of the pipes, wherein the second calculation process comprises the processer calculating the temperature data by using the ambient temperature data and the pipe data.

5. The method of claim 1, wherein obtaining the confluence point data comprises:

obtaining, by the pipe data acquisition unit, data on a starting point of the plurality of the unit pipes;

obtaining, by the pipe data acquisition unit, data on an ending point of the plurality of the unit pipes; and calculating, by the pipe data acquisition unit, data on which among the at least one of the nodes is the confluence point by using data on the starting point and data on the ending point, wherein the starting point refers to a point at which the fluids flow in, and the ending point refers to a point at which the fluids flow out.

6. The method of claim 5, wherein in calculating the temperature data, the processor calculates data on the temperature of the node according to whether the node is the confluence point using the confluence point data.

7. The method of claim 6, wherein the second calculation process comprises obtaining, by the processor, data on heat loss rate of the unit pipe using the temperature data for at least one of the unit pipes.

8. The method of claim 7, wherein the pipes comprise a supply pipe that defines a path from an outlet of a heating section in which the fluids flow from an outlet of a heating section where the fluids are heated to an inlet of an emission section where thermal energy transferred to the fluids in the heating section is transferred to the consumer, and a return pipe that defines a path in which the fluids flow from the outlet of the emission section until returning to the inlet of the heating section, wherein the calculation process is performed independently of the return pipe and the supply pipe.

9. The method of claim 8, wherein the first calculation data further comprises:

calculated pressure data on pressure of the fluids at the at least one point of the pipes; and head data on a head of the fluids at the at least one point of the pipes;

elapsed time data indicating a time taken for the fluids to flow and pass through a reference section connecting a reference point of the pipes and an analysis point of the pipes for each of at least one of the reference sections.

10. The method of claim 9 further comprising a visualization process of a display unit visually displaying physical information of the district heating network corresponding to the analysis data.

11. The method of claim 10, wherein the storing process comprises:

storing, by a first storage device, the analysis data; and temporarily storing, by a second storage device, data to be updated among the analysis data.

12. The method of claim 5, wherein calculating, by the pipe data acquisition unit, data on which among the nodes is a confluence point is determining the node as a divergence point when the node is a starting point of at least two unit pipes, and determining the node as a confluence point when the node is an ending point of the at least two unit pipes.

13. The method of claim 1, further comprising inputting, by a user, the input data.

* * * * *